US005621274A

United States Patent [19]

McGuigan

[11] Patent Number: 5,621,274

[45] Date of Patent: Apr. 15, 1997

[54] LAMINATED EL DISPLAY

[75] Inventor: Ralph M. McGuigan, Phoenix, Ariz.

[73] Assignee: Durel Corporation, Chandler, Ariz.

[21] Appl. No.: 607,714

[22] Filed: Feb. 27, 1996

[51] Int. Cl.[6] ..... H01J 1/62; H01J 63/04; G09G 3/10

[52] U.S. Cl. ..... 313/512; 313/505; 315/169.3

[58] Field of Search ..... 313/498, 500, 313/504, 506, 510–512; 174/52.1, 52.4, 52.5, 61, 62; 315/1, 169.3

[56] References Cited

U.S. PATENT DOCUMENTS

| | | | |
|---|---|---|---|
| 4,593,228 | 6/1986 | Albrechtson et al. | 313/512 X |
| 4,687,968 | 8/1987 | Frayer | 313/512 X |
| 4,967,117 | 10/1990 | Yoshioka et al. | 313/512 X |
| 5,019,748 | 5/1991 | Appelberg | 313/502 X |
| 5,045,755 | 9/1991 | Appelberg | 313/498 |
| 5,189,969 | 3/1993 | Sharpless et al. | 313/505 X |
| 5,410,217 | 4/1995 | LaPointe | 313/502 X |
| 5,453,661 | 9/1995 | Auciello et al. | 313/505 X |

*Primary Examiner*—Sandra L. O'Shea
*Assistant Examiner*—Mack Haynes
*Attorney, Agent, or Firm*—Cahill, Sutton & Thomas P.L.C.

[57] ABSTRACT

An EL panel has the material around each lamp removed to form a first rail and a second rail and a plurality of lamps mechanically isolated from each other and located on predetermined centers between the rails. Each lamp is connected to each rail by an arm and each arm includes a hole for locating the panel in a fixture. The arms are collinear and intersect the rails at an angle of 45°. The panel is located in a fixture by pins through the holes in the arms and laminated to a backing plate or other device, also located in the fixture.

6 Claims, 1 Drawing Sheet

LAMINATED EL DISPLAY

BACKGROUND OF THE INVENTION

This invention relates to an electroluminescent (EL) panel and, in particular, to an EL panel laminated to another structure having a different coefficient of thermal expansion from the EL panel. As used herein, an EL "panel" is a single strip from which one or more lamps can be made, e.g. by cutting the strip.

An electroluminescent (EL) panel is essentially a capacitor having a dielectric layer between two conductive electrodes, one of which is transparent. The dielectric layer can include a phosphor powder or there can be a separate layer of phosphor powder adjacent the dielectric layer. The phosphor powder radiates light in the presence of a strong electric field, using very little current. The front electrode is typically a thin, transparent layer of indium tin oxide or indium oxide and the rear electrode is typically a polymer binder, e.g. polyvinylidene fluoride (PVDF), polyester, vinyl, or epoxy, containing conductive particles such as silver or carbon. The front electrode is applied to a polymer substrate such as a sheet of polyester or polycarbonate to provide mechanical integrity and support for the other layers.

It is often desired to laminate an EL panel with another structure to produce a display. Often, the other structure has a coefficient of thermal expansion different from the polymer substrate, which makes it difficult to maintain critical dimensions along the length of the panel. As an example for the purpose of describing the invention, it is desired to laminate an EL panel having a length of about nine inches and a width of about two inches to an aluminum sheet of about the same size. After lamination, a plurality of lamps are to be punched from the panel and it is desired that the lamps be on precise centers.

The polymer substrate used for EL lamps is typically a bi-axially oriented plastic, meaning that the plastic has been stressed in two, perpendicular directions during manufacture. Uni-axially oriented plastic is used occasionally. In either case, heating the substrate during lamination causes unpredictable changes in dimension as the stress in the plastic is relieved, i.e. the change in dimension is non-linear.

When several lamps are to be made from a panel, electrical connections to the several lamps are provided in the form of patterned electrodes and contact areas. If the panel is laminated, the locations of these areas are no longer precisely known. Existing technology can locate a feature within ±0.012" on a panel. This is not sufficient for some applications. Thus, it is difficult to use a laminated EL panel in automatic assembly equipment.

As recognized in the art, automatic equipment requires that cumulative error be small. This requirement is usually met by making each component or performing each step in a process as precisely as possible. High precision parts are more expensive than low precision parts. An alternative is to make equipment adaptive but this is too expensive, at least for existing equipment. Another alternative is to re-design a product to minimize the number of critical dimensions, which is also expensive.

In view of the foregoing, it is therefore an object of the invention to provide a method for laminating EL panels more precisely than in the prior art without increasing the cost of the panel.

Another object of the invention to provide a method for laminating EL panels in which lamps are located within ±0.002".

SUMMARY OF THE INVENTION

The foregoing objects are achieved in this invention in which an EL panel has the material around each lamp removed to form a first rail and a second rail and a plurality of lamps mechanically isolated from each other and located on predetermined centers between the rails. Each lamp is connected to each rail by an arm and each arm includes a hole for locating the panel in a fixture. In a preferred embodiment of the invention, the arms are collinear and intersect the rails at an angle of 45°. The panel is located in a fixture by pins through the holes in the arms and laminated to a backing plate or other device, also located in the fixture.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
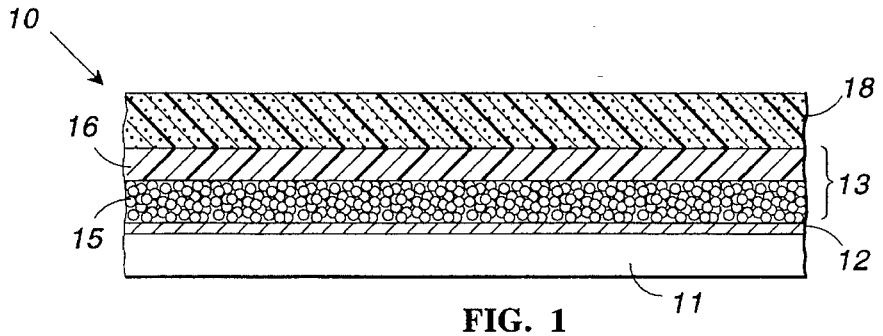
FIG. 1 (PRIOR ART)
FIG. 1 is a cross-section of an EL panel.

FIG. 1 is a cross-section of an EL panel constructed in accordance with the prior art. The various layers are not shown in proportion. In panel 10, transparent substrate 11 is a sheet of bi-axially oriented plastic such as polyester or polycarbonate. Transparent electrode 12 overlies substrate 11 and is a thin layer of indium tin oxide or indium oxide. Electroluminescent dielectric layer 13 includes phosphor layer 15 and dielectric layer 16. Layers 15 and 16 can be combined in some applications. Overlying dielectric layer 16 is rear electrode 18 containing conductive particles such as silver or carbon in a resin binder.

Figure 2:
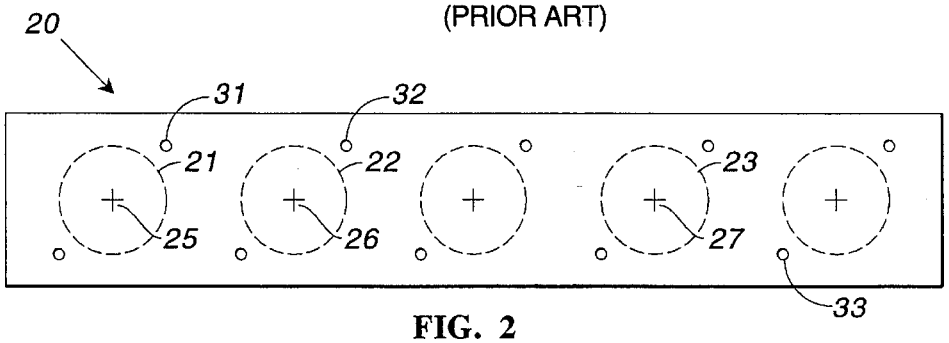
FIG. 2 illustrates a pre-punched aluminum backing strip.

FIG. 2 illustrates an aluminum backing strip to which an EL panel is to be laminated. Strip 20 includes a plurality of pre-punched areas, such as 21, 22, and 23 on centers 25, 26, and 27. Alignment holes, such as holes 31, 32, and 33 are located on predetermined centers along the length and width of strip 20. These alignment holes engage pins (not shown in FIG. 2.) attached to a fixture for laminating strip 20 to an EL panel. Strip 20 is made from aluminum and is relatively stable dimensionally, i.e. the strip changes linearly in dimension, and has a thermal coefficient of expansion of approximately $17\times10^{-6}/°$ C.

Figure 3:
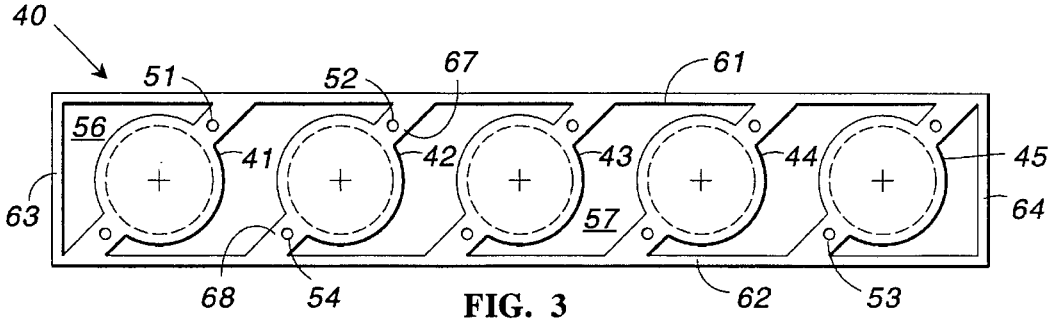
FIG. 3 is a plan view of an EL panel constructed in accordance with the invention.

FIG. 3 is a plan view of an EL panel constructed in accordance with the invention for lamination with strip 20. In FIG. 3, panel 40 includes a plurality of circular lamps 41–45 and a plurality of alignment holes such as holes 51, 52, 53, and 54. Substantial areas are cut or punched from panel 40, such as area 56 and 57, leaving lamps 41–45 connected between rails 61 and 62. Rails 61 and 62 are approximately parallel, extending along the length of panel 40, and are connected at the ends by bars 63 and 64 to form a perimeter frame on panel 40.

Each lamp is individually attached between rails 61 and 62 by suitable arms. For example, lamp 42 is connected to rail 61 by arm 67 and is connected to rail 62 by arm 68. Arm 67 includes alignment hole 52 and arm 68 includes alignment hole 54. Thus, each lamp is connected between opposed alignment holes. In a preferred embodiment of the invention, arms 67 and 68 are collinear and positioned at an angle of approximately 45° to the rails. Other orientations can be used instead.

An EL lamp panel typically has an average coefficient of thermal expansion of about $50\times10^{-6}$/° C. but, because of the stresses in bi-axially oriented films, dimensional changes are non-linear and somewhat unpredictable. The alignment holes are therefore preferably punched after lamps 41–45 are formed. A visual alignment tool is used to find the center of each lamp and the alignment holes are punched relative to each center.

Figure 4:
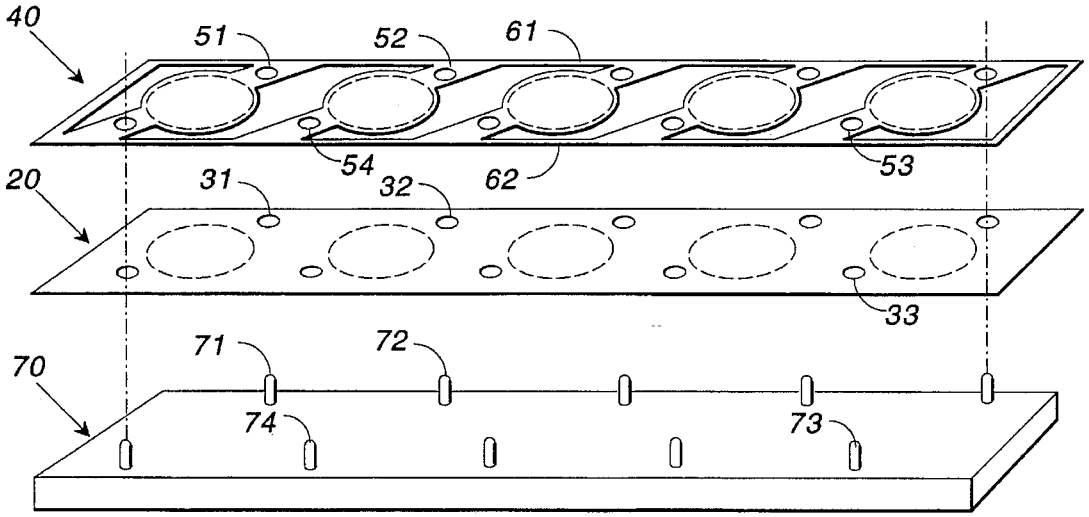
FIG. 4 illustrates the lamination of an EL panel with another member.

FIG. 4 illustrates the assembly of an EL lamp panel and a backing strip onto a fixture for lamination. Fixture 70 includes a plurality of locating pins, such as pins 71, 72, 73 and 74. Backing strip 20 is applied to fixture 70 such that pins 71–73 engage holes 31–33. Panel 40 is then applied with pins 71–74 engaging holes 51–54. The pins in fixture 70 hold lamps 41–45 in position as the fixture is closed and heated for lamination. An adhesive is applied to the rear of the EL panel, e.g. by roll coating, or a separate adhesive interlayer is used between the backing strip and the panel.

The pins locate each lamp individually in the fixture. Dimensional distortion is determined by the pins in the fixture, which is much more stable than the lamp panel. Further, the movement of the center of the lamp is minimized because each lamp is suspended between the opposed rails. For example, if pin 72 moves a distance d relative to pin 74, the center of lamp 42 would move a distance of only d/2. Distortion of the panel itself is largely confined to rails 61 and 62, which are relatively narrow and stretch easily when heated. Distortion of the rails does not affect the center-to-center spacing of the lamps because the locating pins in fixture 70 prevent the distortion from being coupled to the lamps. By individually locating the lamps between rails, the center to center spacing of the lamps can be held to within ±0.002" or less.

The invention thus provides a method for laminating EL panels more precisely than in the prior art without increasing the cost of the panel, in particular, provides a method for laminating EL panels in which lamps are located within ±0.002".

Having thus described the invention, it will be apparent to those of skill in the art that various modifications can be made within the scope of the invention. For example, the number, size, and location of the alignment holes can be changed from what is shown, although it is preferred that two alignment holes be located along the extended diameter of a lamp, i.e. on opposites sides of a lamp. An aluminum backing strip is described by way of example only. Other materials could be used instead, such as sheet brass or plastic. The backing strip could be located by some other feature, such as a recess in the fixture, instead of by pins.

What is claimed as the invention is:

1. An EL panel having a plurality of lamps on precise centers, said panel comprising:

a first rail and a second rail;

a plurality of lamps located on said centers between said rails, wherein each lamp is connected to said first rail by a first arm and is connected to said second rail by a second arm; and a plurality of holes for locating said panel in a fixture.

2. The EL panel as set forth in claim 1 wherein said plurality of holes includes a hole in said first arm and a hole in said second arm of each of said lamps.

3. The EL panel as set forth in claim 1 wherein said arms are collinear and intersect said first rail and said second rail at an angle.

4. The EL panel as set forth in claim 3 wherein said angle is approximately 45°.

5. A method for laminating a plurality of EL lamps in a panel to another structure with said EL lamps on precise centers, said method comprising the steps of:

providing an EL panel from which said EL lamps are to be made;

removing portions of said panel from between said EL lamps to produce a pair of opposed rails with said EL lamps connected between said rails by arms extending to each rail;

locating said EL panel in a fixture with said structure; and laminating said EL panel to said structure.

6. The method as set forth in claim 5 wherein said locating step is preceded by the step of forming at least one hole in each arm; and said locating step includes the step of inserting a locating pin through the hole in each arm for locating each lamp individually in said fixture.

* * * * *